US010465922B2

(12) United States Patent
Lim et al.

(10) Patent No.: US 10,465,922 B2
(45) Date of Patent: Nov. 5, 2019

(54) OUTDOOR UNIT FOR AIR CONDITIONER

(71) Applicant: LG ELECTRONICS INC., Seoul (KR)

(72) Inventors: Hyunjun Lim, Seoul (KR); Hoki Lee, Seoul (KR); Jonghwan Jeung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 211 days.

(21) Appl. No.: 15/153,366

(22) Filed: May 12, 2016

(65) Prior Publication Data

US 2017/0059189 A1 Mar. 2, 2017

(30) Foreign Application Priority Data

Aug. 25, 2015 (KR) ..... 10-2015-0119501

(51) Int. Cl.

| | |
|---|---|
| ***F24F 1/10*** | (2011.01) |
| ***F24F 1/26*** | (2011.01) |
| ***F24F 1/56*** | (2011.01) |
| ***F24F 1/32*** | (2011.01) |
| ***F24F 1/50*** | (2011.01) |
| ***F24F 1/16*** | (2011.01) |

(52) U.S. Cl.

CPC ..... *F24F 1/10* (2013.01); *F24F 1/16* (2013.01); *F24F 1/26* (2013.01); *F24F 1/32* (2013.01); *F24F 1/50* (2013.01); *F24F 1/56* (2013.01)

(58) Field of Classification Search

CPC ..... F24F 1/32; F24F 1/50; F24F 1/10; F24F 1/16; F24F 1/26; F24F 1/56; F24F 1/22; F24F 1/24

See application file for complete search history.

(56) References Cited

U.S. PATENT DOCUMENTS 5,943,872 A * 8/1999 Sakurada ..... F24F 1/0011 62/262
2005/0150247 A1* 7/2005 Ishihara ..... F24F 1/26 62/507

(Continued)

FOREIGN PATENT DOCUMENTS

CN 1098499 A 2/1995
CN 1374483 A 10/2002

(Continued)

*Primary Examiner* — Frantz F Jules
*Assistant Examiner* — Martha Tadesse
(74) *Attorney, Agent, or Firm* — Dentons US LLP

(57) ABSTRACT

An outdoor unit for an air conditioner is provided. The outdoor unit includes a base disposed on lower portions of suction panels, the base having two long sides and two short sides, legs respectively disposed on lower portions of the two long sides of the base, a compressor and an outdoor heat exchanger disposed on an upper portion of the base, a refrigerant tube connecting the compressor and the outdoor heat exchanger to each other, a plurality of service valve assemblies connected to the refrigerant tube, and a plurality of connection tubes respectively connected to the plurality of service valve assemblies to extend downward from the base. The plurality of connection tubes are aligned at a first alignment position at which they extend toward the front of the base or a second alignment position at which they extend toward a side of the base.

14 Claims, 13 Drawing Sheets

(56) References Cited

U.S. PATENT DOCUMENTS

| | | | | |
|---|---|---|---|---|
| 2009/0107161 | A1* | 4/2009 | Jang | F24F 1/26 62/259.1 |
| 2011/0219803 | A1* | 9/2011 | Park | F24F 1/26 62/238.6 |
| 2014/0290304 | A1* | 10/2014 | Park | F24F 1/08 62/426 |

FOREIGN PATENT DOCUMENTS

| | | | |
|---|---|---|---|
| CN | 1374484 | A | 10/2002 |
| CN | 1262798 | C | 7/2006 |
| CN | 101189478 | A | 5/2008 |
| CN | 101424428 | A | 5/2009 |
| CN | 102192624 | A | 9/2011 |
| EP | 1 953 464 | A1 | 8/2008 |
| EP | 2 056 029 | A2 | 5/2009 |
| EP | 2 716 982 | A2 | 4/2014 |
| EP | 2 716 983 | A2 | 4/2014 |
| KR | 10-2003-0037029 | A | 5/2003 |
| KR | 10-2006-0002442 | A | 1/2006 |
| KR | 10-2009-0044508 | A | 5/2009 |
| KR | 10-1371886 | B1 | 3/2014 |

* cited by examiner

OUTDOOR UNIT FOR AIR CONDITIONER

CROSS-REFERENCE TO RELATED APPLICATIONS

The present application claims priority under 35 U.S.C. § 119 and 35 U.S.C. § 365 to Korean Patent Application No. 10-2015-0119501, filed on Aug. 25, 2015, which is hereby incorporated by reference.

BACKGROUND

1. Field

The present disclosure relates to an outdoor unit for an air conditioner.

1. Background

An air conditioner is an apparatus for maintaining air in a predetermined space at a desired temperature. The air conditioner generally includes a compressor, a condenser, an expansion device, and an evaporator. The air conditioner drives a refrigeration cycle in which compression, condensation, expansion, and evaporation processes of a refrigerant are performed, to cool or heat the predetermined space.

When the air conditioner performs a cooling operation, an outdoor heat exchanger provided in an outdoor unit functions as a condenser, and an indoor heat exchanger disposed in an indoor unit functions as an evaporator. To the contrary, when the air conditioner performs a heating operation, the indoor heat exchanger functions as the condenser, and the outdoor heat exchanger functions as the evaporator.

The outdoor unit for the air conditioner generally includes several refrigerant tubes to guide flow of refrigerants between the outdoor unit and the indoor unit. The refrigerant tubes generally consist of a liquid tube through which a liquid refrigerant flows, a low-pressure gas tube through which a low-pressure gas refrigerant flows, and a high-pressure gas tube through which a high-pressure gas refrigerant flows.

The refrigerant tubes may include service valves capable of selectively opening/closing the respective refrigerant tubes in repair of the outdoor unit, replacement of a refrigerant tube, or charging of a refrigerant. The service valves may be installed in the liquid tube, the low-pressure gas tube, and the high-pressure gas tube, respectively.

For example, Korean Patent Registration No. 10-1371886, filed on Mar. 3, 2014, discloses a supporter structure that supports the plurality of refrigerant tubes or the service valves. The supporter may support the plurality of refrigerant tubes or the service valves such that installation heights or lateral positions of the liquid tube, the low-pressure gas tube, and the high-pressure gas tube are different from each other, or such that installation heights or lateral positions of the service valves installed in the respective refrigerant tubes are different from each other.

According to this configuration, interference caused by adjacent refrigerant tubes or service valves could be prevented in replacement or repair of the plurality of refrigerant tubes or in an operation of the service valves. However, the outdoor unit was configured such that the shape or arrangement of a plurality of connection tubes extending from the service valves to a downside of a base of the outdoor unit. Therefore, if the installation direction of the outdoor unit is changed, installation of the plurality of connection tubes is difficult, and interference occurs due to adjacent connection tubes in a service operation.

SUMMARY

The embodiments of the present disclosure provide an outdoor unit for an air conditioner, which facilitates connection of a refrigerant tube extending therefrom.

In one embodiment, an outdoor unit for an air conditioner includes a base, a plurality suction panels provided on the base, the suction panels forming a front surface, a right side surface, a left side surface, and a rear surface of the outdoor unit, a compressor that compresses a refrigerant, a heat exchanger to heat exchange the refrigerant, a refrigerant tube connected to the compressor and the heat exchanger, a plurality of service valve assemblies connected to the refrigerant tube; and a plurality of connection tubes respectively connected to the plurality of service valve assemblies, the plurality of connection tubes extending through the base.

The plurality of connection tubes may be aligned at a first alignment position in which they extend toward the front of the base. The first alignment position being a position at which the plurality of connection tubes are bent toward the front of the base from the plurality of service valve assemblies to be aligned in a lateral direction.

The plurality of connection tubes may be aligned at a second alignment position in which they extend toward a lateral side of the base. The second alignment position being a position at which the plurality of connection tubes are bent toward the lateral side of the base from the plurality of service valve assemblies to extend at different heights from each other.

The outdoor unit may further include a plurality of legs respectively disposed at opposite sides of a bottom surface of the base, wherein the base includes a first and a second side respectively corresponding to the front and rear surfaces, and a third and a fourth side respectively corresponding to the side surfaces.

The details of one or more embodiments are set forth in the accompanying drawings and the description below. Other features will be apparent from the description and drawings, and from the claims.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

Figure 1:
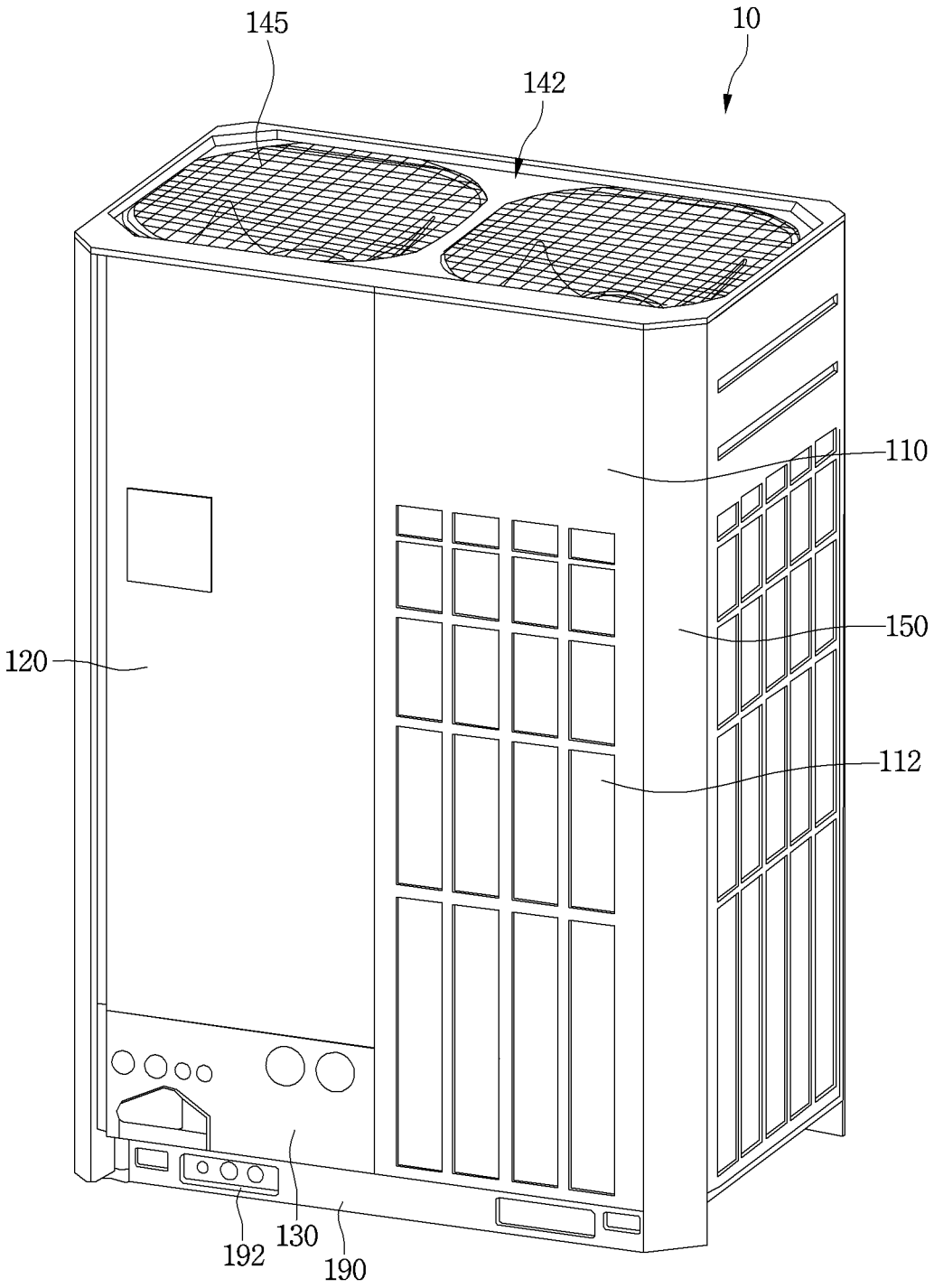
FIG. 1 is a perspective view illustrating a configuration of an outdoor unit for an air conditioner according to a first embodiment of the disclosure.
Figure 2:
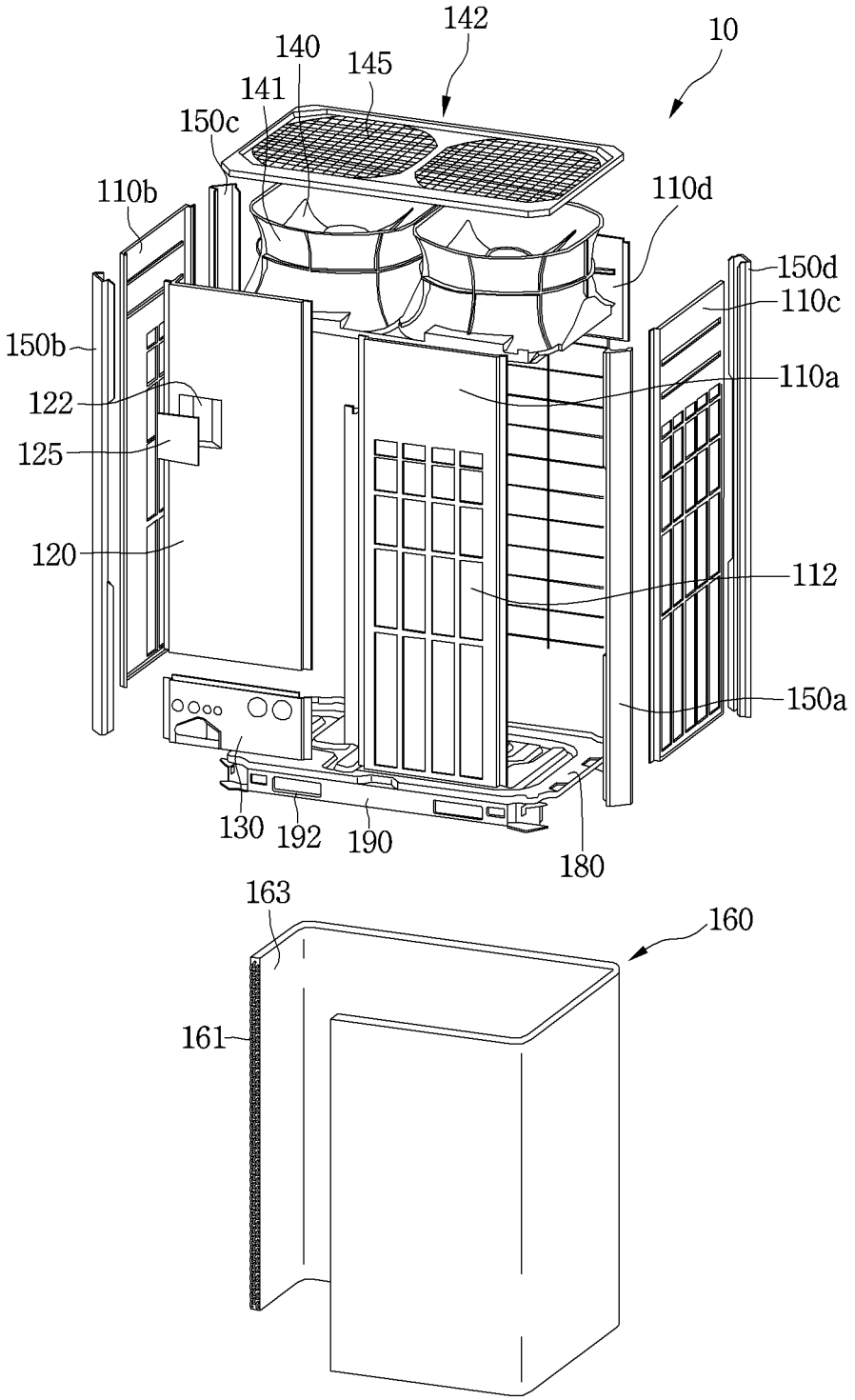
FIG. 2 is an exploded perspective view illustrating the configuration of the outdoor unit for the air conditioner according to the embodiment of FIG. 1.
Figure 3:
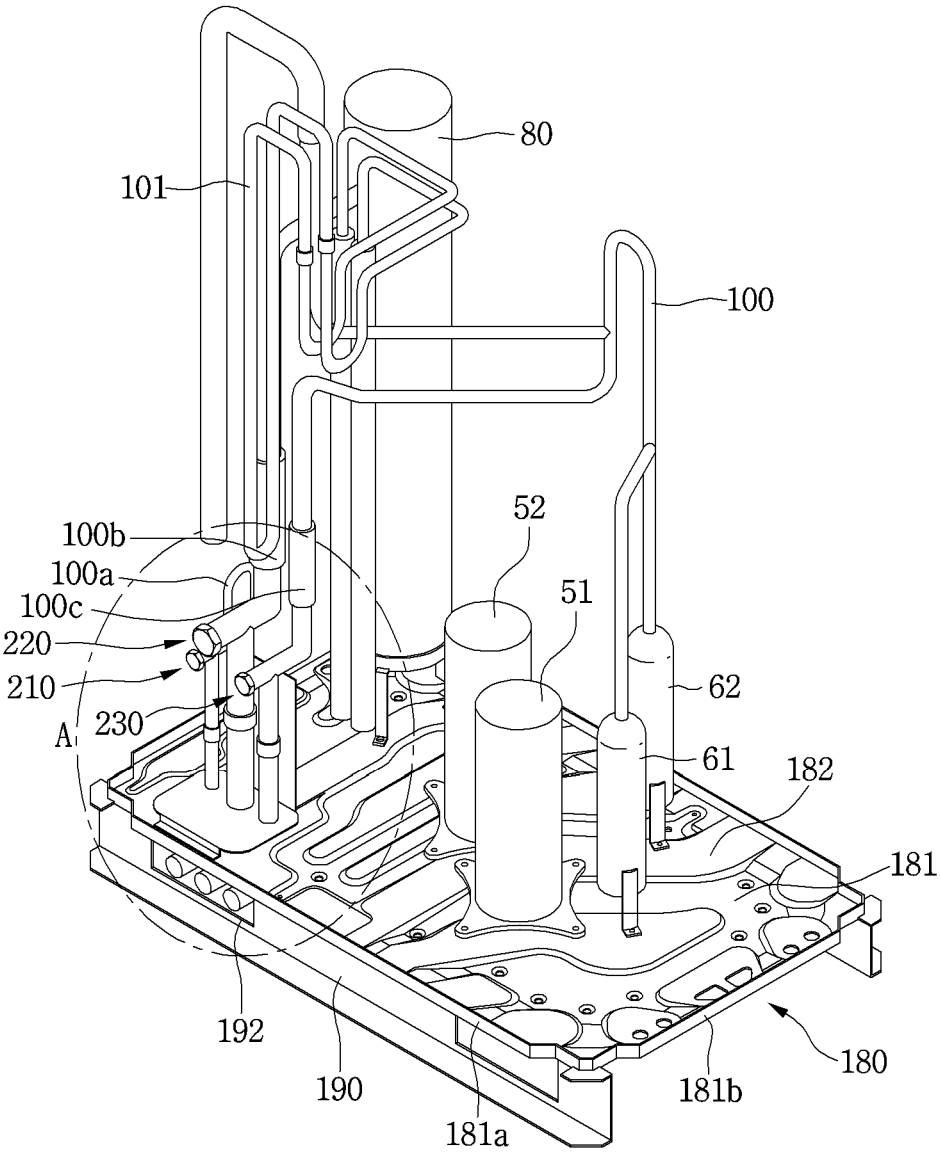
FIG. 3 is a perspective view illustrating a state in which a plurality of components are disposed on a base of the outdoor unit according to the embodiment of FIG. 1.

FIG. 1 is a perspective view illustrating a configuration of an outdoor unit for an air conditioner according to an embodiment of the disclosure. FIG. 2 is an exploded perspective view illustrating the configuration of the outdoor unit for the air conditioner according to the embodiment of FIG. 1. FIG. 3 is a perspective view illustrating a state in which a plurality of components are provided on a base of the outdoor unit according to the embodiment of FIG. 1.

Referring to FIGS. 1 to 3, the outdoor unit 10 for the air conditioner includes a base 180 providing a lower outer appearance of the outdoor unit 10. The base 180 supports a plurality of components provided inside the outdoor unit 10. The outdoor unit 10 may further includes legs 190 provided at a lower side of the base 180 to support the outdoor unit 10 to at an installation location. The outdoor unit 10 further includes a cabinet 110, 120, 130, and 150 provided at an upper side of the base 180.

The legs 190 may be provided at opposite sides of the lower side of the base 180. Specifically, the base 180 may have a plate shape including two long sides and two short sides, e.g., rectangular shape. For example, the legs 190 may be provided at lower portions of the two long sides of the base 180, respectively.

A hole 192 may be formed in each of the legs 190. A plurality of connection tubes 250, 260, and 270 (see FIG. 4) may extend to an exterior side of the outdoor unit 10 through the hole 192, or may be exposed through the hole 192 to be connected to a refrigerant tube connected to an indoor unit.

The cabinet 110, 120, 130, and 150 includes a suction panel 110. The suction panel 110 may include a plurality of suction panels 110 disposed along at least one edge of the base 180. That is, the plurality of suction panels 110 may be disposed to extend upward from an edge of the base 180.

For example, the plurality of suction panels 110 may be disposed at front and rear sides and left and right sides of the base 180. The plurality of suction panels 110 may include suction grills 112 through which outdoor air is introduced into the outdoor unit 10. The outdoor air may be introduced into the outdoor unit 10 through the plurality of suction panels 110.

The cabinet 110, 120, 130, and 150 further includes a control panel 120. The control panel 120 may be an openable door that provides access to a control box 70 (see FIG. 5) located inside the outdoor unit 10. For example, the control panel 120 may be rotatably hinged or slidably attached.

The cabinet 110, 120, 130, and 150 may further include a service panel 130 disposed at a portion of the control panel 120. The service panel 130 may be separable from the outdoor unit 10 in an operation for manipulating a service valve assembly, replacing or welding a refrigerant tube, or the like. The service panel 130 may be provided at a lower portion of the control panel 120.

The control panel 120 and the service panel 130 may be disposed at a lateral side of suction panel 110, which may be disposed at a front side of the outdoor unit 10 among the plurality of suction panels 110.

For clarification purposes, a surface at which the control panel 120 is disposed is generally referred to herein as a "front surface" of the outdoor unit 10. The surfaces disposed at both sides of the front surface of the outdoor unit 10 are generally referred to herein as "both side surfaces," "left/right surface(s)," or "side surface(s)" of the outdoor unit 10. Also, the surface disposed opposite the front surface of the outdoor unit 10 is generally referred to herein as a "rear surface" of the outdoor unit 10.

The plurality of suction panels 110 may include four suction panels. For example, the control panel 120 and a first suction panel 110*a* disposed at a lateral side of the control panel 120 may be disposed at or form the front surface of the outdoor unit 10. A second suction panel 110*b* disposed in a direction perpendicular to the control panel 120 may be disposed at or form a left surface of the outdoor unit 10. A third suction panel 110*c* disposed in a direction perpendicular to the first suction panel 110*a* may be disposed at or form a right surface of the outdoor unit 10. A fourth suction panel 110*d* disposed in a direction perpendicular to the left and right surfaces of the outdoor unit 10 may be disposed at or form the rear surface of the outdoor unit 10.

The control panel 120 may include a viewing window 122 through which a display of the control box 70 can be seen and a cover member 125 for selectively opening the viewing window 122.

The cabinet 110, 120, 130, and 150 may include a bracket 150 that supports the plurality of suction panels 110 and the control panel 120. The bracket 150 may be provided as a single bracket or as a plurality of brackets. The plurality of brackets 150 may be disposed to extend upward from a surface of the base 180.

Specifically, the plurality of brackets 150 may include a first bracket 150*a* disposed between the first suction panel 110*a* and the third suction panel 110*c* disposed adjacent to the first suction panel 110*a* to support the first and third suction panels 110*a* and 110*c*. The first and third suction panels 110*a* and 110*c* may be coupled to the first bracket 150*a*.

The plurality of brackets 150 may further include a second bracket 150*b* disposed between the second suction panel 110*b* and the control panel 120 disposed adjacent to the second suction panel 110*b* to support the second suction panel 110*b* and the control panel 120. The second suction panel 110*b* and the control panel 120 may be coupled to the second bracket 150*b*.

The plurality of brackets 150 may further include a third bracket 150*c* disposed between the second suction panel 110*b* and the fourth suction panel 110*d* to support the second and fourth suction panels 110*b* and 110*d*. The second and fourth suction panels may be coupled to the third bracket 150*c*.

The plurality of brackets 150 may further include a fourth bracket 150*d* disposed between the third and fourth suction panels 110*c* and 110*d* to support the third and fourth suction panels 110*c* and 110*d*. The third and fourth suction panels 110*c* and 110*d* may be coupled to the fourth bracket 150*d*.

A heat exchanger 160 may be installed inside the outdoor unit 10. The heat exchanger 160 may extend along inner surfaces of the cabinet 110, 120, 130 and 150. In other words, the heat exchanger 130 may be bent several times to extend along inner surfaces of the plurality of suction panels 110. Also, the heat exchanger 160 may be disposed at an edge portion that is a long side of the base 180 and an edge portion that is a short side of the base 180.

For example, the heat exchanger 160 may be bent three times to extend, and may have four surfaces. The four surfaces may be disposed to face the four suction panels.

In such configuration, the four surfaces may include a first surface facing the front surface of the outdoor unit 10 and disposed at one edge portion that is one long side of the base 180, a second surface facing the left surface of the outdoor unit 10 and disposed at another edge portion that is one short side of the base 180, a third surface facing the right surface of the outdoor unit 10 and disposed at yet another edge portion that is the other short side of the base 180, and a fourth surface facing the rear surface of the outdoor unit 10 and disposed at yet another edge portion that is the other long side of the base 180.

The heat exchanger 160 may include heat exchange tubes 161 through which a refrigerant flows and a heat exchange fin 163 coupled to the heat exchange tubes 161 to assist heat exchange of the refrigerant. The heat exchange tubes 161 constitute at least a portion of a refrigerant tube 100, and the heat exchange fin 163 provides a surface for exchanging heat between the refrigerant and air. The outdoor air introduced through the suction grills 112 of the plurality of suction panels 110 may be heat-exchanged while passing through the heat exchanger 160. The refrigerant tube 100 may connect with a plurality of components installed in the outdoor unit For example, the heat exchange tubes 161 may be configured in three lines, and the heat exchange fin 163 may include first, second, and third fins coupled to the respective heat exchange tubes 161 configured in three lines.

The outdoor unit 10 may further include a blower fan 140 for introducing the outdoor air and a fan housing 141 that at least partially surrounds the blower fan 140. The outdoor unit 10 may further include a discharge panel 142 disposed at one side of the blower fan 140. The discharge panel 142 may include a discharge grill 145 through which the air is discharged to the outside of the outdoor unit 10.

The blower fan 140 may be disposed at an upper portion of the outdoor unit 10. The discharge panel 142 may be disposed at an upper portion of the outdoor unit 10 and above the blower fan 140. The air passing through the heat exchanger 160 may flow upward and be discharged outside of the outdoor unit 10 by passing through the blower fan 140 and the discharge panel 142.

A plurality of components may be disposed at an upper portion of the base 180. The base 180 includes a base main body 181. The main base body 181 may have an substantially rectangular shape. The base 180 may further include a plurality of seat parts 182 protruding from the base main body 181 to allow the plurality of components to be supported thereon.

As shown in FIG. 3, the base main body 181 may include two long sides 181*a* and two short sides 181*b*. Accordingly, the two long sides 181*a* may define front and rear sides of the base 180, respectively, and the two short sides 181*b* may define both sides of the base 180, respectively. In addition, the legs 190 may be disposed at lower portions of the two long sides 181*a*, respectively.

The plurality of components may include at least compressors 51 and 52 compressing the refrigerant, oil separators 61 and 62 respectively disposed at discharge sides of the compressors 51 and 52 to separate oil contained in the refrigerant, a gas-liquid separator 80 disposed at an inlet-side of the compressors 51 and 52 to separate a liquid refrigerant, thereby supplying a gas-phase refrigerant into the compressors 51 and 52, and the refrigerant tube 100 connected to the compressors 51 and 52, the oil separators 61 and 62, and the gas-liquid separator 80 to guide flow of the refrigerant.

The compressors 51 and 52 include a first compressor and a second compressor 52. The oil separators 61 and 62 include a first oil separator 61 disposed at an outlet-side of the first compressor 51 and a second oil separator 62 disposed at an outlet-side of the second compressor 52.

The heat exchanger 160 may be provided to at least partially surround the compressors 51 and 52, the oil separators 61 and 62, and the gas-liquid separator 80.

The refrigerant tube 100 may include a liquid tube 100*a* as a "first tube" through which a liquid refrigerant flows, a low-pressure gas tube 100*b* as a "second tube" through which a low-pressure gas-phase refrigerant flows, and a high-pressure gas tube 100*c* as a "third tube" through which a high-pressure gas-phase refrigerant flows. The liquid tube 100*a* may be a refrigerant tube through which a condensed refrigerant flows, the low-pressure gas tube 100*b* may be a refrigerant tube through which an evaporated refrigerant flows, and the high-pressure gas tube 100*c* may be a refrigerant tube through which a compressed refrigerant flows.

For example, during a cooling operation of the air conditioner, a refrigerant condensed in the heat exchanger 160 may flow through the liquid tube 100*a*, a refrigerant evaporated from a heat exchanger of the indoor unit may flow through the low-pressure gas tube 100*b*, and a refrigerant compressed in the compressors 51 and 52 may flow through the high-pressure gas tube 100*c*.

The refrigerant tube 100 may further include a cooling tube 101 coupled to one side of the control box 70 to cool the control box 70. For example, the cooling tube 101 may constitute at least a portion of the liquid tube 100*a*.

The outdoor unit 10 may further include valve assemblies 210, 220, and 230 as "service valve assemblies" respectively connected to the liquid tube 100*a*, the low-pressure gas tube 100*b*, and the high-pressure gas tube 100*c*. Specifically, the valve assemblies 210, 220, and 230 may include a first valve assembly 210 connected to the liquid tube 100*a*, a second valve assembly 220 connected to the low-pressure gas tube 100*b*, and a third valve assembly 230 connected to the high-pressure gas tube 100*c*. The valve assemblies 210, 220, and 230 may operate to selectively open/close the liquid tube 100*a*, the low-pressure gas tube 100*b*, and the high-pressure gas tube 100*c*, respectively.

Figure 4:
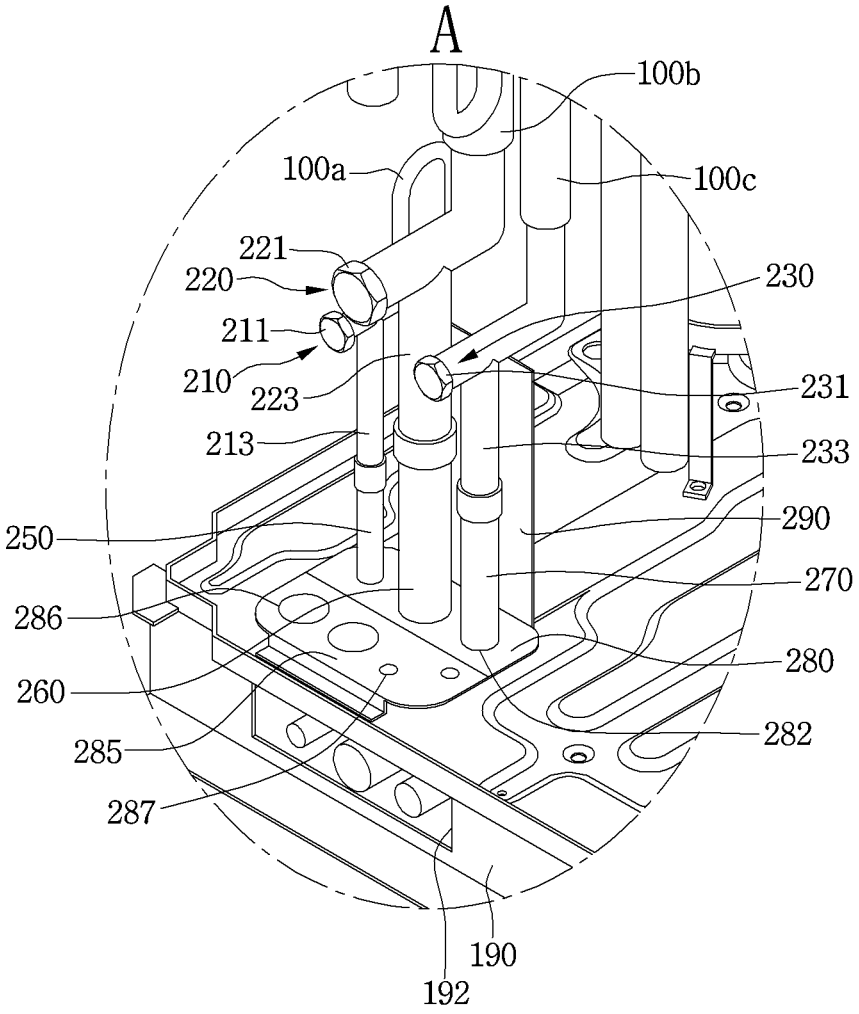
FIG. 4 is an enlarged view of portion A illustrated in FIG. 3.
Figure 5:
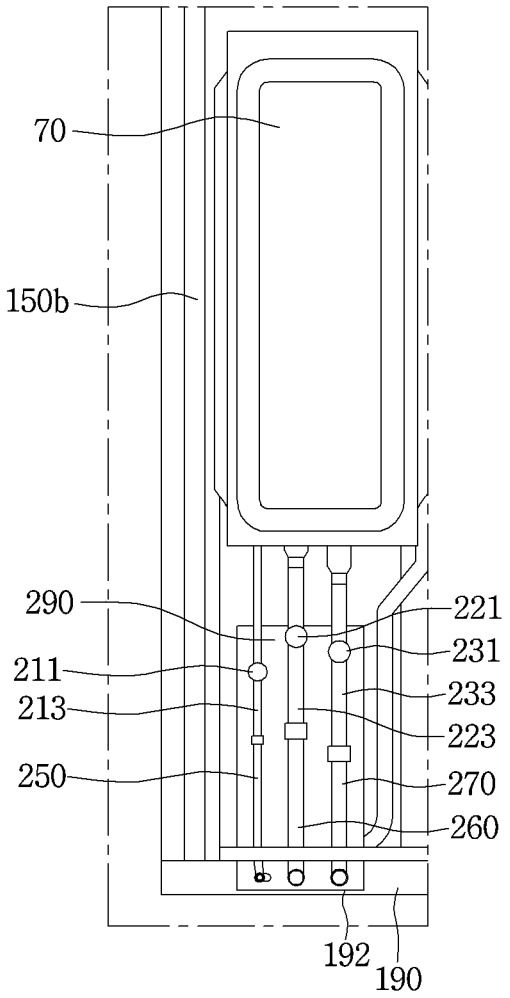
FIG. 5 is a front view illustrating components of the outdoor unit according to the embodiment of FIG. 1.

FIG. 4 is an enlarged view of portion A of FIG. 3. FIG. 5 is a front view illustrating certain components of the outdoor unit according to an embodiment of the disclosure. Referring to FIGS. 4 and 5, the outdoor unit 10 according to the embodiment includes the first valve assembly 210, the second valve assembly 220, and the third valve assembly 230.

As shown, the first valve assembly 210 includes a first valve 211 for selectively opening/closing the liquid tube 100*a* and a first service tube 213 extending to both sides of the first valve 211. The first service tube 213 may include a first tube portion connected to the liquid tube 100*a* and a second tube portion connected to a first connection tube 250.

For example, the first tube portion of the first service tube 213 may extend backward from the first valve 211 to be connected to the liquid tube 100*a*. The second tube portion of the first service tube 213 may extend downward from the first valve 211 to be connected to the first connection tube 250.

The first connection tube 250 may extend downward from the first service tube 213 to pass through the base 180, and may be bent at the lower portion of the base 180 and extend to the front of the base 180.

The second valve assembly 220 may include a second valve 221 for selectively opening/closing the low-pressure gas tube 100*b* and a second service tube 223 extending to both sides of the second valve 221. The second service tube 223 may include a first tube portion connected to the low-pressure gas tube 100*b* and a second tube portion connected to a second connection tube 260.

For example, the first tube portion of the second service tube 223 may extend backward from the second valve 221 to be connected to the low-pressure gas tube 100*b*. The second tube portion of the second service tube 223 may extend downward from the second valve 221 to be connected to the second connection tube 260.

The second connection tube 260 may extend downward from the second service tube 223 to pass through the base 180, and may be bent at the lower portion of the base 180 and extend to the front of the base 180.

The third valve assembly 230 may include a third valve 231 for selectively opening/closing the high-pressure gas tube 100*c* and a third service tube 233 extending to both sides of the third valve 231. The third service tube 233 may include a first tube portion connected to the high-pressure gas tube 100*c* and a second tube portion connected to a third connection tube 270.

For example, the first tube portion of the third service tube 233 may extend backward from the third valve 231 to be connected to the high-pressure gas tube 100*c*. The second tube portion of the third service tube 233 may extend downward from the third valve 231 to be connected to the third connection tube 270.

The third connection tube 270 may extend downward from the third service tube 233 to pass through the base 180, and may be bent at the lower portion of the base 180 and extend to the front of the base 180.

The outdoor unit 10 may further include a supporter 290 capable of supporting the first, second, and third valve assemblies 210, 220, and 230. The supporter 290 may include support grooves (not shown) formed therein for supporting the respective service tubes 213, 223, and 233 of the first, second, and third valve assemblies 210, 220, and 230.

The support grooves may be formed at different heights or may be formed at different positions in the front-back direction. Thus, the heights of the first, second, and third valve assemblies 210, 220, and 230, or the positions of the first, second, and third valve assemblies 210, 220, and 230 in the front-back position are different from each other. Accordingly, when an operator performs a service operation of a valve assembly, the operator can perform the operation without any influence of adjacent valve assemblies.

For example, the second valve assembly 220 may be positioned above the first valve assembly 210, and the first valve assembly 210 may be positioned above the third valve assembly 230.

Accordingly, a lower end of the second service tube 223 connected to the second connection tube 260 may be positioned above the first service tube 213 connected to the first connection tube 250. Also, a lower end of the first service tube 213 may be positioned above the third service tube 233 connected to the third connection tube 270.

Correspondingly, the height of an upper end of the second connection tube 260 may be above an upper end of the first connection tube 250. The height of the upper end of the first connection tube 250 may be above an upper end of the third connection tube 270.

The outdoor unit 10 may further include a heat insulator 280 provided at an upper surface of the base 180. The position at which the heat insulator 280 is disposed may correspond to the positions at which the first, second, and third connection tubes 250, 260, and 270 pass through the base 180. Insertion holes 282 through which the first, second, and third connection tubes 250, 260, and 270 pass, respectively, may be formed in the heat insulator 280.

In installation process of the outdoor unit 10, the heat insulator 280 functions to stop through-holes of the base 280 before the first, second, and third connection tubes 250, 260, and 270 are connected to the first, second, and third valve assemblies 210, 220, and 230, respectively. Here, the through-holes of the base 180 may be holes through which the first, second, and third connection tubes 250, 260, and 270 pass.

The heat insulator 280 is configured to prevent foreign substances from being introduced into the outdoor unit 10 when, for example, the outdoor unit 10 is moved or installed. The heat insulator 280 is also configured to prevent internal components of the outdoor unit 10 from being damaged by an external impact, etc.

The outdoor unit 10 may further include a line bracket 285 provided at the upper surface of the base 180. For example, the line bracket 285 may be provided at the front of the heat insulator 280.

The line bracket 285 may be a device for supplying power to the outdoor unit 10 or transmitting communication signals to the outdoor unit 10. The line bracket 285 may include, for example, a first hole 286 through which power lines pass and a second hole 287 through which communication lines pass.

The control box 70 may be provided above the first, second, and third valve assemblies 210, 220, and 230. The service panel 130 may be opened to access the control box 70 or the first, second, and third valve assemblies 210, 220, and 230, the control panel 120.

Figure 6:
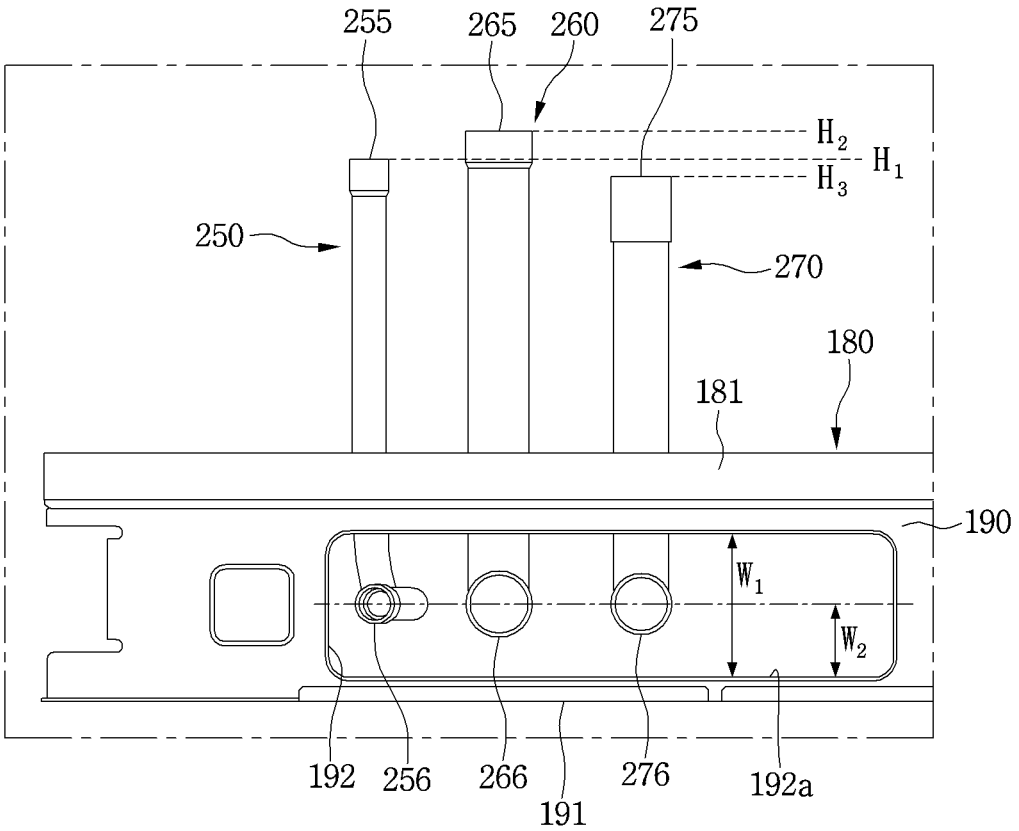
FIG. 6 is a view illustrating a state in which a plurality of connection tubes are aligned to extend to the front of the base according to another embodiment of the disclosure.
Figure 7:
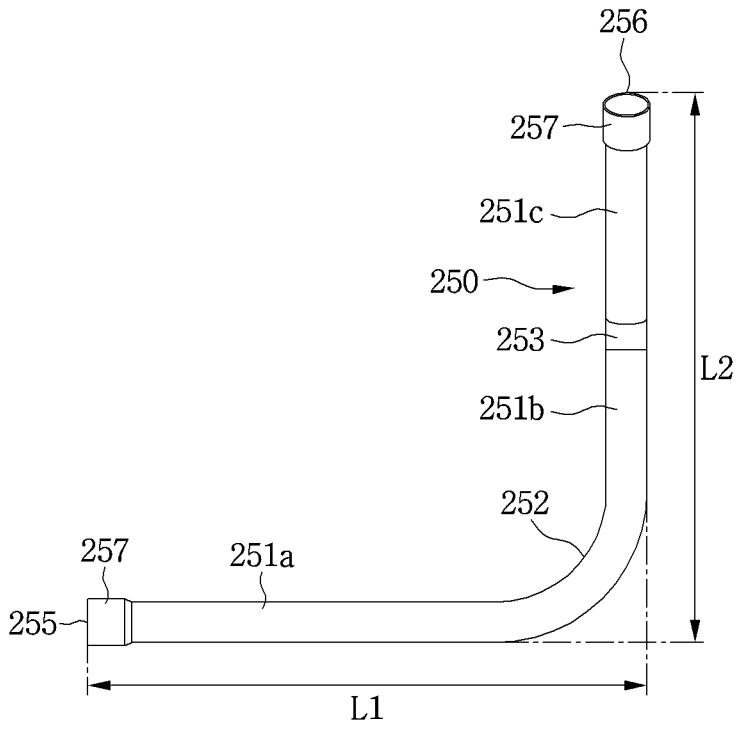
FIG. 7 is a view illustrating a configuration of a first connection tube according to the embodiment of FIG. 6.
Figure 8:
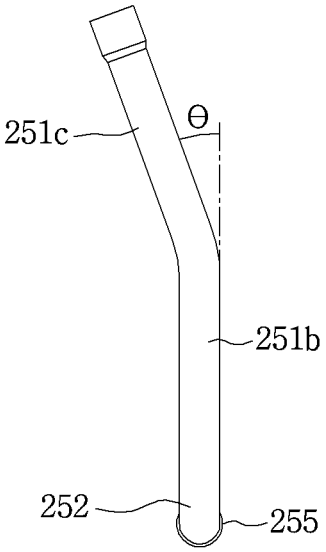
FIG. 8 is a view illustrating a configuration of a first connection tube according to the embodiment of FIG. 6.
Figure 9:
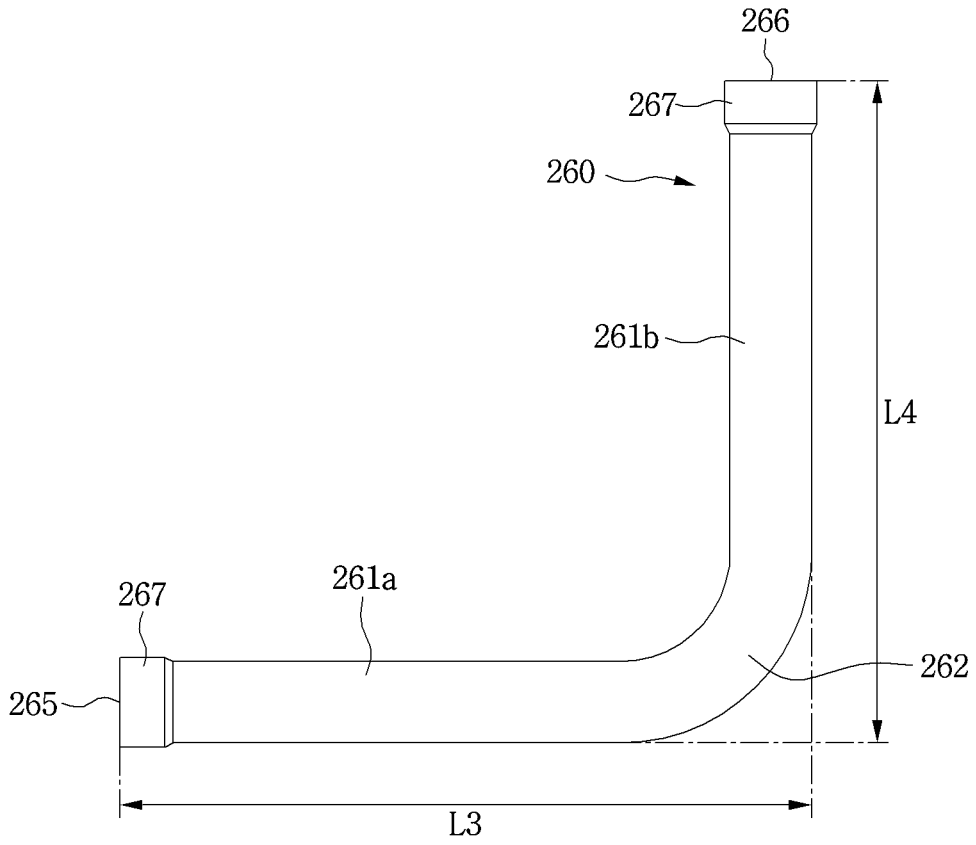
FIG. 9 is a view illustrating a configuration of a second connection tube according to the embodiment of FIG. 6.
Figure 10:
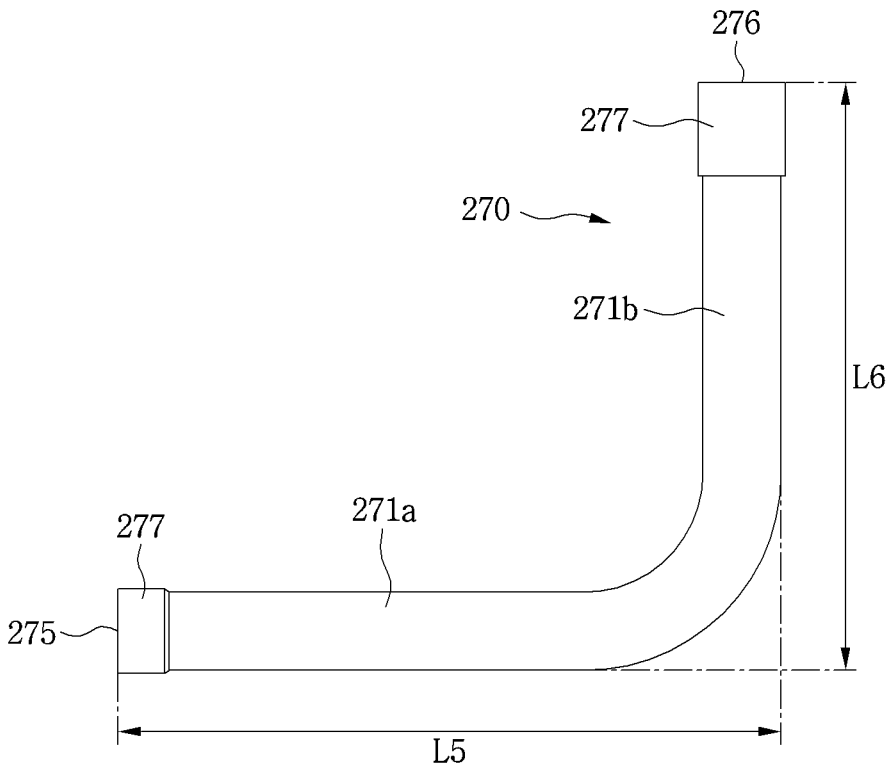
FIG. 10 is a view illustrating a configuration of a third connection tube according to the embodiment of FIG. 6.

FIG. 6 is a view illustrating a state in which a plurality of connection tubes are aligned to extend to the front of the base according to an embodiment of the disclosure. FIGS. 7 and 8 are views illustrating a configuration of the first connection tube according to the embodiment. FIG. 9 is a view illustrating a configuration of the second connection tube according to the embodiment. FIG. 10 is a view illustrating a configuration of the third connection tube according to the embodiment.

Referring to FIGS. 6 to 10, the heights of the upper ends of the first, second, and third connection tubes 250, 260, and 270 may be different from each other, and the heights of lower ends of the first, second, and third connection tubes 250, 260, and 270 may be approximately equal to each other.

The first connection tube 250 may include a tube main body 251, 251*b*, and 251*c* and a plurality of bending parts 252 and 253 for bending or curving the tube main body 251*a*, 251*b*, and 251*c*.

Specifically, the tube main body 251*a*, 251*b*, and 251*c* may have a cylindrical pipe-like shape, and include a first tube part 251*a*, a second tube part 251*b*, and a third tube part 251*c*. The first tube part 251*a* may extend in a first direction, the second tube part 251*b* may extend in a second direction, and the third tube part 251*c* may extend in a third direction.

The plurality of bending parts 252 and 253 may include a first bending part 252 changing an extending direction from the first tube part 251*a* to the second tube part 251*b*, and a second bending part 253 changing an extending direction from the second tube part 251*b* to the third tube part 251*c*.

For example, the first bending part 252 may be bent or curved from the first direction to the second direction, and the second bending part 253 may be bent or curved from the second direction to the third direction. In other words, the first connection tube 250 may be configured such that the first tube part 251*a*, the first bending part 252, the second tube part 251*b*, the second bending part 253, and the third tube part 251*c* sequentially extend.

The angle formed by the second and third directions is referred to herein as a setting angle θ. According to an embodiment of the disclosure, the setting angle θ may be approximately 20 degrees.

Tube expansion parts 257 may be provided at both side portions of the first connection tube 250, respectively. Specifically, the tube expansion parts 257 may be connected to the first and third tube parts 251*a* and 251*c*, respectively, and the diameters of the tube expansion parts 257 may expand such that other tubes can be coupled to the first connection tube 250 at both the side portions of the first connection tube 250 therethrough.

In addition, ends 255 and 256 of the first connection tube 250 may be formed at the tube expansion parts 257, respectively. The ends 255 and 256 may include a first end 255 that is an end of the first tube part 251*a* and a second end 256 that is an end of the third tube part 251*c*.

The longest distance in the first direction from the first end 255 of the first tube part 251*a* to the first bending part 252 is referred to herein as L1. In addition, when the third tube part 251*c* is projected in the second direction, the longest distance in the second direction from the second end 256 of the third tube part 251*c* to the first bending part 252 is referred to herein as L2.

L1 and L2 may be equal to each other, or L1 may be greater than the L2. For example, L1 may be 202.8 mm and L2 may be 202 mm.

The second connection tube 260 may include a tube main body 261*a* and 261*b* and a bending part 262 for bending or curving the tube main body 261*a* and 261*b*. The second connection tube 260 may have an approximately "ㄱ" shape, and the diameter of the second connection tube 260 may be greater than that of the tube main body of the first connection tube 250.

The tube main body 261*a* and 261*b* may have a cylindrical pipe-like shape, and include a first tube part 261*a* and a second tube part 261*b*. The first tube part 261*a* may extend in the first direction, and the second tube part 261*b* may extend in the second direction.

The bending part 262 is configured to change an extending direction from the first tube part 261*a* to the second tube part 261*b* between the first and second tube parts 261*a* and 261*b*.

Tube expansion parts 267 may be provided at both side portions of the second connection tube 260, respectively. The tube expansion parts 267 may be provided to the first and second tube parts 261*a* and 261*b*, respectively, and the diameters of the tube expansion parts 267 may expand such that other tubes can be coupled to the second connection tube 260 at both the side portions of the second connection tube 260 therethrough.

The ends 265 and 266 of the second connection tube 260 may be formed at the tube expansion parts 267, respectively. The ends 265 and 266 may include a first end 265 provided at an end of the first tube part 261*a* and a second end 266 provided at an end of the second tube part 261*b*.

The longest distance in the first direction from the first end 265 of the first tube part 261*a* to the bending part 262 is referred to herein as L3. The longest distance in the second direction from the second end 266 of the second tube part 261*b* to the bending part 262 is referred to herein as L4.

L3 may be greater than L4. L3 may also be greater than L1 or L2. L4 may be less than L1 or L2. For example, L3 may be 215 mm and L4 may be 200 mm.

The third connection tube 270 may include a tube main body 271*a* and 271*b* and a bending part 272 for bending or curving the tube main body 271*a* and 271*b*. The third connection tube 270 may have an approximately "ㄱ" shape, and the diameter of the third connection tube 270 may be greater than that of the tube main body of the first connection tube 250.

The tube main body 271*a* and 271*b* may have a cylindrical pipe-like shape, and include a first tube part 271*a* and a second tube part 271*b*. The first tube part 271*a* may extend in the first direction, and the second tube part 271*b* may extend in the second direction.

The bending part 262 is configured to change an extending direction from the first tube part 271*a* to the second tube part 271*b* between the first and second tube parts 271*a* and 271*b*.

Tube expansion parts 277 are provided at both side portions of the third connection tube 270, respectively. The tube expansion parts 277 may be provided to the first and second tube parts 271*a* and 271*b*, respectively, and the diameters of the tube expansion parts 277 may expand such that other tubes can be coupled to the third connection tube 270 at both the side portions of the third connection tube 270 therethrough.

The ends 275 and 276 of the third connection tube 270 may be formed in the tube expansion parts 277, respectively. The ends 275 and 276 may include a first end 275 provided at an end of the first tube part 271*a* and a second end 276 provided at an end of the second tube part 271*b*.

The longest distance in the first direction from the first end 275 of the first tube part 271*a* to the bending part 272 is referred to herein as L5. The longest distance in the second direction from the second end 276 of the second tube part 271*b* to the bending part 272 is referred to herein as L6.

L5 may be greater than L6. L5 may be less than the L3 and greater than the L4. L6 may be less than L1, L2, L3, or L4. For example, L5 may be 205 mm and L6 may be 182 mm.

Meanwhile, when the installation position of the outdoor unit 10 is determined such that the refrigerant tube connecting the outdoor unit 10 and the indoor unit to each other extends to the front of the outdoor unit 10, the first, second, and third connection tubes 250, 260, and 270 may be aligned as shown in FIG. 6. The alignment shown in FIG. 6 is referred to herein as a "front alignment" or "first alignment." In such alignment, the bottom ends of the first, second, and third connection tubes 250, 260, and 270 may be exposed or extend toward the front of the outdoor unit 10.

Specifically, the position of the front alignment may be understood as a position at which the first, second, and third connection tubes 250, 260, and 270 are bent toward the front of the base 180 from the plurality of valve assemblies 210, 220, and 230 to be aligned in a lateral direction.

In the front alignment, the first ends 255, 265, and 275 of the first, second, and third connection tubes 250, 260, and 270 may be connected to the first, second, and third service tubes 213, 223, and 233 while forming upper ends, respectively. The second ends 256, 266, and 276 of the first, second, and third connection tubes 250, 260, and 270 may be exposed or extend through the hole 192 of the leg 190 while forming lower ends.

In the front alignment, the heights of the upper ends of the first, second, and third connection tubes 250, 260, and 270 may be different from each other. The reference point for the heights may be measured from the ground surface at which the leg 190 is supported, i.e., a lower end 191 of the leg 190.

The height of the upper end of the first end 255 of the first connection tube 250—referred to herein as H1—may be lower than that of the height of the upper end of the first end 265 of the second connection tube 260—referred to herein as H2, and may be higher than of the height of the upper end of the first end 275 of the third connection tube 270—referred to herein as H3.

The differences in height between the first, second, and third connection tubes 250, 260, 270 result from that the heights of the first, second, and third valve assemblies 210, 220, and 230 are different from each other.

Specifically, the installation height of the second valve assembly 220 may be higher than that of the first valve assembly 210, and the installation height of the first valve assembly 210 may be higher than that of the third valve assembly 230. In other words, the lower end of the second service tube 223 connected to the second connection tube 260 may be positioned higher than that of the first service tube 213 connected to the first connection tube 250. In addition, the lower end of the first service tube 213 may be positioned higher than that of the third service tube 233 connected to the third connection tube 270.

Correspondingly, the height of the upper end, i.e., the first end 265 of the second connection tube 260, may be higher than that of the upper end, i.e., the first end 255 of the first connection tube 250, and the height of the upper end of the first connection tube 250 may be higher than that of the upper end, i.e., the first end 275 of the third connection tube 270.

On the other hand, the heights of the lower ends, i.e., the second ends 256, 266, and 276 of the first, second, and third connection tubes 250, 260, and 270 are approximately equal to each other. In addition, based on a lower end 192*a* of the hole 192, the height W2 of the lower ends of the first, second, and third connection tubes 250, 260, and 270 may have a set ratio with respect to the width W1 of the hole 192 in the vertical direction. For example, W2=1/2*W1.

Thus, the lower ends 256, 266, 276 of the first, second, and third connection tubes 250, 260, and 270 may be aligned in the lateral direction while being spaced apart from each other, and can be positioned at the same height from the ground surface. Accordingly, when a service operator performs an operation on the first, second, and third connection tubes 250, 260, and 270, it is possible to prevent one connection tube from being interfered with other adjacent connection tubes.

In addition, the heights of the lower ends 256, 266, and 276 are formed at a middle position of the width of the hole 192 in the vertical direction. Thus, when the service operator performs an operation, it is possible to prevent interference caused by an edge of the hole 192.

Figure 11:
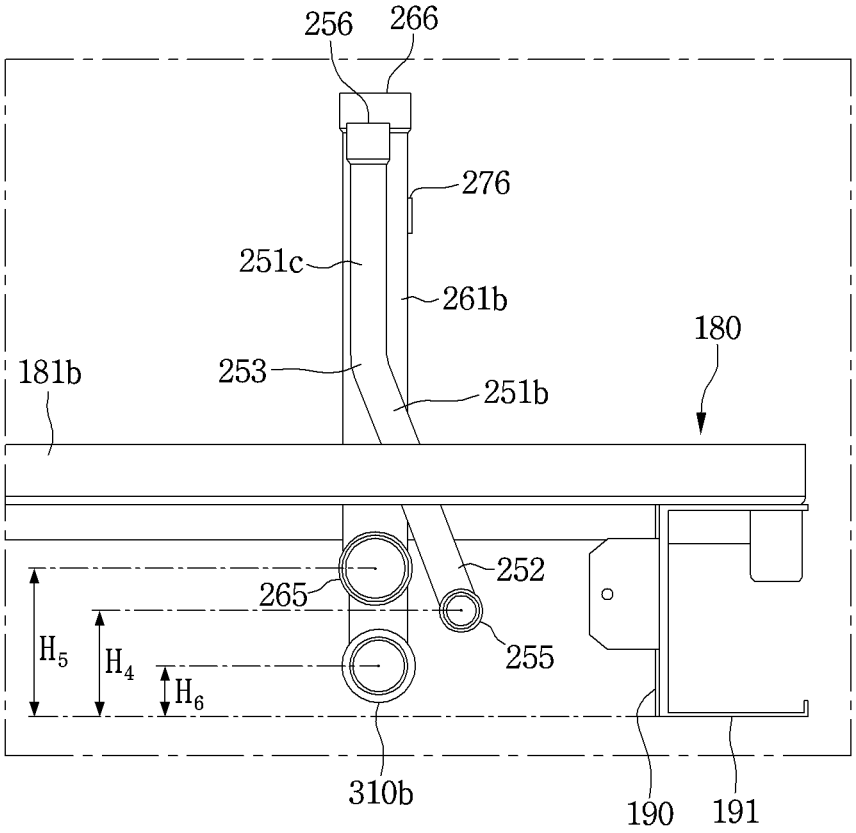
FIG. 11 is a view illustrating a state in which the plurality of connection tubes are aligned to extend to a side of the base according to another embodiment of the disclosure.
Figure 12:
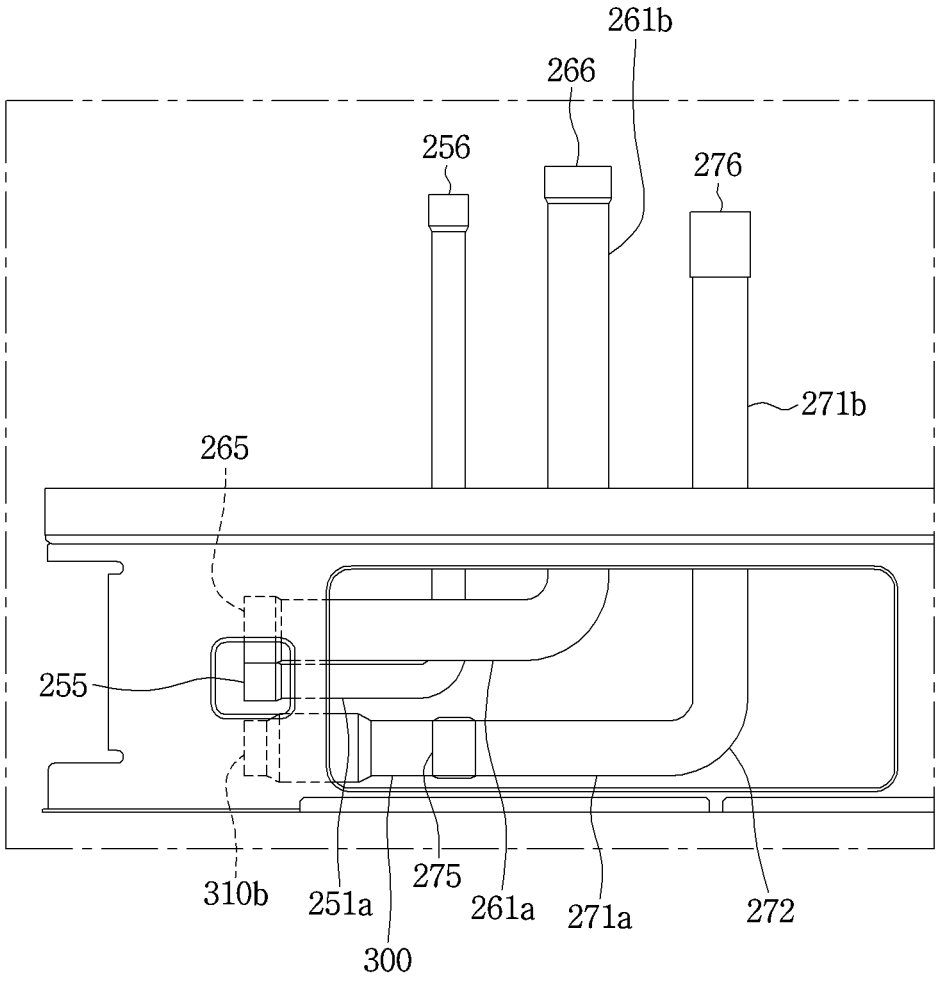
FIG. 12 is another view illustrating a state in which the plurality of connection tubes are aligned to extend to a side of the base according to another embodiment of the disclosure.
Figure 13:
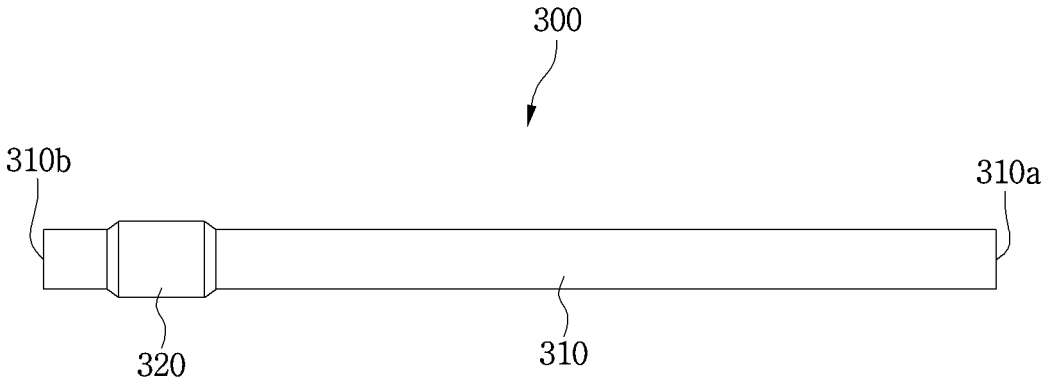
FIG. 13 is a view illustrating a fourth connection tube coupled to the third connection tube when the plurality of connection tubes are aligned as shown in FIGS. 11 and 12.

FIGS. 11 and 12 are views illustrating a state in which the plurality of connection tubes are aligned to extend to a side of the base according to an embodiment of the disclosure. FIG. 13 is a view illustrating a fourth connection tube coupled to the third connection tube when the plurality of connection tubes are aligned as shown in FIGS. 11 and 12.

Referring to FIGS. 11 to 13, the first, second, and third connection tubes 250, 260, and 270 may be aligned such that the lower ends of the first, second, and third connection tubes 250, 260, and 270 are exposed or extend toward a side of the outdoor unit 10. Such configuration is referred to herein as a "side alignment" or "second alignment."

The side alignment may be an alignment state of the first, second, and third connection tubes 250, 260, and 270 when the installation position of the outdoor unit 10 is determined such that the refrigerant tube connecting the outdoor unit 10 and the indoor unit to each other extends to a side of the outdoor unit 10.

Specifically, side alignment may include a configuration at which the first, second, and third connection tubes 250, 260, and 270 are bent toward a side of the base 180 from the plurality of valve assemblies 210, 220, and 230 to extend at different heights from each other.

Meanwhile, when the first, second, and third connection tubes 250, 260, and 270 are aligned in a side direction, the outdoor unit 10 may further include a fourth connection tube 300 connected to the third connection tube 270. The fourth connection tube 300 may include a tube main body 310 having a cylindrical pipe-like shape and a tube expansion part 320 provided at one portion of the tube main body 310. In addition, the tube main body 310 may include a first end 310*a* connected to the first end 275 of the third connection tube 270 and a second end 310*b* exposed to a side of the outdoor unit 10.

In the side alignment, the first tube part 271*a* of the third connection tube 270 may be configured to extend sufficiently to the side of the outdoor unit 10 so that an operator can more easily perform an operation with only the length of the first tube part 271*a*. Thus, the fourth connection tube 300 is connected to the third connection tube 270 so that the third connection tube 270 can be sufficiently exposed to the side of the outdoor unit 10.

In the side alignment, the second ends 256, 266, and 276 of the first, second, and third connection tubes 250, 260, and 270 may be connected to the first, second, and third service tubes 213, 223, and 233 while forming upper ends, respectively. The first ends 255, 265, and 275 of the first, second, and third connection tubes 250, 260, and 270 may also form lower ends, respectively. The fourth connection tube 300 may be connected to the third connection tube 270. Therefore, the first ends 255 and 265 of the first and second connection tubs 250 and 260, and the second end 276 of the third connection tube 270 may be exposed or extend to the side of the outdoor unit 10 at the lower portion of the base 180.

In other words, the positions of the first, second, and third connection tubes 250, 260, and 270 in the side alignment may respectively correspond to the positions at which the first, second, and third connection tubes 250, 260, and 270 are turned over in the front alignment.

In the side alignment, the heights of the upper ends of the first, second, and third connection tubes 250, 260, and 270 may be different from each other, and the heights of the lower ends of the first, second, and third connection tubes 250, 260, and 270 may be different from each other. The reference point from the heights may be measured from the ground surface at which the leg 190 is supported.

The heights of the upper ends, i.e., the second ends 256, 266, and 276 of the first, second, third connection tubes 250, 260, and 270 are different from each other, as described above, results from the differences in height between the first, second, and third valve assemblies 210, 220, and 230.

In addition, the heights of the lower ends, i.e., the first ends 255, 265, and 275 of the first, second, and third connection tubes 250, 260, and 270 are different from each other as shown in FIG. 11. That the heights of the first, second, and third connection tubes 250, 260, and 270 are different from each other as described above results from the length of the tube main body of each connection tube, the shape in which the first connection tube 250 is bent several times, and the like.

Specifically, the height of the first end 255 of the first connection tube 250 defines H4, and the height of the first end 265 of the second connection tube 260 is referred to herein as H5. For example, H5 may be higher than H4, and H4 may be higher than H3.

As described above, the first ends 255, 265, 275 of the first, second, and third connection tubes 250, 260, and 270, which are exposed to the short side 181*b* of the base 180 form different heights from each other, so that operators can more easily perform operations without any interference caused by adjacent connection tubes.

As described in the above embodiments, it is determined whether the direction in which the connection tubes extend to the outside of the outdoor unit is to be the front of the base 180 or a side of the base 180, depending on an installation position or installation state of the outdoor unit. In addition, the alignment of the first, second, and third connection tubes is changed based on the determined direction, so that an operator can easily perform an operation.

According to the present disclosure, a plurality of connection tubes are aligned to be exposed to the front or a side of the base depending on an installation direction of the outdoor unit. Thus, it is possible to facilitate a tube connection operation between the indoor unit and the outdoor unit.

Particularly, when the plurality of connection tubes extend to the front of the base, the plurality of connection tubes are aligned in a lateral direction (front alignment). When the plurality of connection tubes extend to the side of the base, the plurality of connection tubes are aligned with different heights in a longitudinal direction (side alignment). Thus, it is possible to prevent interference caused by adjacent connection tubes in an operation for connecting or welding a connection tube.

Also, the connection tubes connected to the liquid tube, the high-pressure gas tube, and the low-pressure gas tube have different shapes or lengths. Thus, the front alignment or side alignment of the plurality of the connection tube can be easily made.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor unit for an air conditioner, comprising:

a base;

a plurality of suction panels provided on the base, the plurality of suction panels forming a front surface, a right side surface, a left side surface, and a rear surface of the outdoor unit;

a compressor to compress a refrigerant;

a heat exchanger to heat exchange the refrigerant;

a plurality of refrigerant tubes connected to the compressor and the heat exchanger, the plurality of refrigerant tubes comprising a liquid tube for passing liquid refrigerant, a low-pressure gas tube and a high-pressure gas tube for passing gas refrigerant;

a plurality of service valve assemblies respectively connected to the plurality of refrigerant tubes;

a plurality of connection tubes respectively connected to the plurality of service valve assemblies, the plurality of connection tubes extending to bend under the base, the plurality of connection tubes comprising a first connection tube connected to the liquid tube, a second connection tube connected to the low-pressure gas tube, and a third connection tube connected to the high-pressure gas tube; and a plurality of legs respectively disposed at opposite sides of a bottom of the base, the plurality of legs including a hole through which the first to the third connection tubes are exposed, wherein each of the first to the third connection tubes comprises:

a first tube part extending in a first direction, the first tube part including a first end defined as an expansion part at one-side end;

a first bending part located at the other-side end of the first tube part and bent to change an extending direction of the first tube part toward a second direction; and a second tube part extending in the second direction from the first bending part, wherein the first connection tube comprises a second bending part bent to change the extending direction of the second tube part toward a third direction and a third tube part extending in the third direction from the second bending part, wherein the first to the third connection tubes are arranged in a first alignment in which the third tube part, the second tube part of the second connection tube and the second tube part of the third connection tube are exposed at a same height through the hole or in a second alignment in which the first tube parts of the first to the third connection tubes are exposed at different height through a space between the legs, and wherein the first to the third connection tubes in the second alignment are connected to the plurality of service valve assemblies by reversing the first to the third connection tubes in the first alignment.

2. The outdoor unit of claim 1, wherein the first alignment is a position at which the plurality of connection tubes are bent toward the front of the base from the plurality of service valve assemblies to be aligned in a lateral direction.

3. The outdoor unit of claim 1, wherein the second alignment is a position at which the plurality of connection tubes are bent toward a lateral side of the base from the plurality of service valve assemblies to extend at different heights from each other.

4. The outdoor unit of claim 1, wherein the base includes a first and a second side respectively corresponding to the front and rear surfaces of the plurality of suction panels, and a third and a fourth side respectively corresponding to the right and left side surfaces of the suction panels.

5. The outdoor unit of claim 1, wherein the third direction of the third tube part is the same direction as the second direction of the second connection tube and the third connection tube.

6. The outdoor unit of claim 1, wherein the plurality of service valve assemblies comprise:

a first valve assembly connected to the liquid tube;

a second valve assembly connected to the low-pressure gas tube; and a third valve assembly connected to the high-pressure gas tube.

7. The outdoor unit of claim 6, wherein the first connection tube extends from the first valve assembly, wherein the second connection tube extends from the second assembly, and wherein the third connection tube extends from the third assembly.

8. The outdoor unit of claim 1, wherein the third tube part, the second tube part of the second connection tube, and the second tube part of the third connection tube include a second end defined as an extension part at each extending end.

9. The outdoor unit of claim 8, wherein the first connection tube is formed such that a first distance (L1) from the first end to the first bending part is longer than a second distance (L2) from the second end to the first bending part.

10. The outdoor unit of claim 9, wherein the second connection tube is formed such that a third distance (L3) from the first end to the first bending part is longer than the first distance and the second distance (L1 and L2), and wherein the second connection tube is formed such that a fourth distance (L4) from the second end to the first bending part is smaller than the first distance and the second distance (L1 and L2).

11. The outdoor unit of claim 10, wherein the third connecting tube is formed such that a distance (L5) from the first end to the first bending part is smaller than the third distance (L3) and longer than the fourth distance (L4), and wherein the third connecting tube is formed such that a distance (L6) from the second end to the first bending part is smaller than the first distance, the second distance, the third distance or the fourth distance (L1, L2, L3 or L4).

12. The outdoor unit of claim 1, further comprising a fourth connection tube connected to the third connection tube, wherein the fourth connection tube extends to a lateral side of the base from the third connection tube at the second alignment.

13. The outdoor unit of claim 1, further comprising:

a heat insulator provided on the base, the heat insulator having insertion holes through which the plurality of connection tubes pass, respectively.

14. The outdoor unit of claim 1, further comprising:

a line bracket provided at a side of the heat insulator, the line bracket having a plurality of holes through which power lines or communication lines pass.

* * * * *